US008461066B2

(12) United States Patent
Robertson et al.

(10) Patent No.: US 8,461,066 B2
(45) Date of Patent: Jun. 11, 2013

(54) NONWOVEN FROM BULKED FILAMENT TOW

(75) Inventors: Raymond M. Robertson, Blacksburg, VA (US); Rene B. Neron, Blacksburg, VA (US); Gary E. Dehart, Peterstown, WV (US)

(73) Assignee: Celanese Acetate LLC, Dallas, TX (US)

( * ) Notice: Subject to any disclaimer, the term of this patent is extended or adjusted under 35 U.S.C. 154(b) by 619 days.

(21) Appl. No.: 11/832,784

(22) Filed: Aug. 2, 2007

(65) Prior Publication Data

US 2009/0036016 A1 Feb. 5, 2009

(51) Int. Cl.

| | |
|---|---|
| ***D04H 3/02*** | (2006.01) |
| ***D04H 3/05*** | (2006.01) |
| ***D04H 3/14*** | (2006.01) |
| ***D04H 5/06*** | (2006.01) |

(52) U.S. Cl.
USPC ..... 442/352; 442/327; 442/353; 442/359

(58) Field of Classification Search
USPC .... 442/352, 356; 156/60, 148, 308.4; 26/3–6; 264/347
See application file for complete search history.

(56) References Cited

U.S. PATENT DOCUMENTS

| | | | | |
|---|---|---|---|---|
| 3,313,665 | A | 4/1967 | Berger | |
| 3,352,735 | A | 11/1967 | Harrington, Jr. et al. | |
| 3,391,048 | A | 7/1968 | Dyer et al. | |
| 3,949,130 | A * | 4/1976 | Sabee et al. | 428/192 |
| 4,280,860 | A | 7/1981 | Shen et al. | |
| 4,351,683 | A * | 9/1982 | Kusilek | 156/167 |
| 4,469,540 | A * | 9/1984 | Furukawa et al. | 156/62.4 |
| 4,507,107 | A | 3/1985 | Berger | |
| 4,704,113 | A * | 11/1987 | Schoots | 604/379 |
| 4,741,941 | A | 5/1988 | Englebert et al. | |
| 5,331,976 | A | 7/1994 | St. Pierre | |
| 5,865,919 | A | 2/1999 | Megchelsen et al. | |
| 5,972,463 | A * | 10/1999 | Martin et al. | 428/95 |
| 6,224,811 | B1 | 5/2001 | Powers et al. | |
| 6,253,431 | B1 | 7/2001 | Ames et al. | |
| 6,448,462 | B2 | 9/2002 | Groitzsch et al. | |
| 6,500,539 | B1 | 12/2002 | Chen et al. | |
| 6,543,106 | B1 | 4/2003 | Ames et al. | |
| 6,983,520 | B2 | 1/2006 | Ames et al. | |
| 7,059,027 | B2 | 6/2006 | Ames et al. | |
| 7,076,848 | B2 | 7/2006 | Ames et al. | |

(Continued)

FOREIGN PATENT DOCUMENTS

| | | |
|---|---|---|
| EP | 1024217 A2 | 2/2000 |
| JP | 05-321109 | 12/1993 |

(Continued)

OTHER PUBLICATIONS

U.S. Appl. No. 11/559,507, filed Nov. 14, 2006, Neron, et al.

*Primary Examiner* — Jennifer A Steele
(74) *Attorney, Agent, or Firm* — Hammer & Associates, P.C.

(57) ABSTRACT

A nonwoven material has a plurality of randomly oriented and bulked crimped filaments, a plurality of point bonds interconnecting said crimped filaments into a fixed, 3-dimensional structure, and either a surface portion of said fixed, 3-dimensional structure having a greater density than an inner portion of said 3-dimensional structure or an external surface of said fixed, 3-dimensional structure being substantially free of any protruding filaments. The nonwoven material is made by: bulking a filament tow, fixing the bulked tow into a 3-dimensional structure, and calendering the 3-dimensional structure.

13 Claims, 4 Drawing Sheets

U.S. PATENT DOCUMENTS

| | | | | |
|---|---|---|---|---|
| 7,103,946 | B2 | 9/2006 | Ames et al. | |
| 7,107,659 | B2 | 9/2006 | Ames et al. | |
| 7,132,377 | B2 | 11/2006 | Borgonjon et al. | |
| 7,181,817 | B2 | 2/2007 | Ames et al. | |
| 2002/0049419 | A1* | 4/2002 | Mizutani et al. | 604/384 |
| 2003/0034115 | A1 | 2/2003 | Barth et al. | |
| 2006/0089074 | A1* | 4/2006 | Barth et al. | 442/408 |
| 2007/0044930 | A1* | 3/2007 | Vinson et al. | 162/158 |
| 2009/0247977 | A1 | 10/2009 | Takeuchi et al. | |

FOREIGN PATENT DOCUMENTS

| | | | |
|---|---|---|---|
| JP | 06-200464 | A | 7/1994 |
| JP | 2001-279542 | A | 10/2001 |
| JP | 2002-360625 | A | 12/2002 |
| WO | WO 2008/060306 | A1 | 5/2008 |

* cited by examiner

NONWOVEN FROM BULKED FILAMENT TOW

FIELD OF THE INVENTION

A nonwoven material is made from a bulked filament tow.

BACKGROUND OF THE INVENTION

U.S. patent application Ser. No. 11/559,507, filed Nov. 14, 2006, discloses a nonwoven material for use as, among other things, a wound dressing. In general, this nonwoven material comprises bulked filaments that are fixed into a 3-dimensional structure. Additionally, this nonwoven is characterized by having a uniform density throughout its thickness and by having filaments that protrude beyond its external surface, see FIG. 1. Moreover, this application discloses that this nonwoven may be subsequently calendered.

Nonwoven is a term of art that refers to a manufactured sheet, batting, webbing, or fabric that is held together by various methods. Those methods include, for example, fusion of fibers (e.g., thermal, ultrasonic, pressure, and the like), bonding of fibers (e.g., resins, solvents, adhesives, and the like), and mechanical entangling (e.g., needle-punching, entangling, and the like). The term is sometimes used broadly to cover other structures such as those held together by interlacing of yarns (stitch bonding) or those made from perforated or porous films. The term excludes woven, knitted, and tufted structures, paper, and felts made by wet milling processes. In its most common usage, the term includes fibrous structures made by such processes as dry, wet, or air-laying (with or without one of the methods of holding the fibers together mentioned above), needle-punching, spunbond or meltblown processes, and hydroentangling (spunlacing). In the dry, wet, air-laying, and hydroentangling (spunlacing) processes, staple fibers are used in the manufacture of the nonwoven material. In the spunbond and meltblown processes, molten polymer is extruded onto a moving belt; the fibers of these types of nonwovens may be filaments.

While the nonwoven material disclosed in U.S. patent application Ser. No. 11/559,507 is an advancement in the art, there is still a need to improve that material.

DESCRIPTION OF THE DRAWINGS

For the purpose of illustrating the invention, there is shown in the drawings a form that is presently preferred; it being understood, however, that this invention is not limited to the precise arrangements and instrumentalities shown.

SUMMARY OF THE INVENTION

Figure 1:
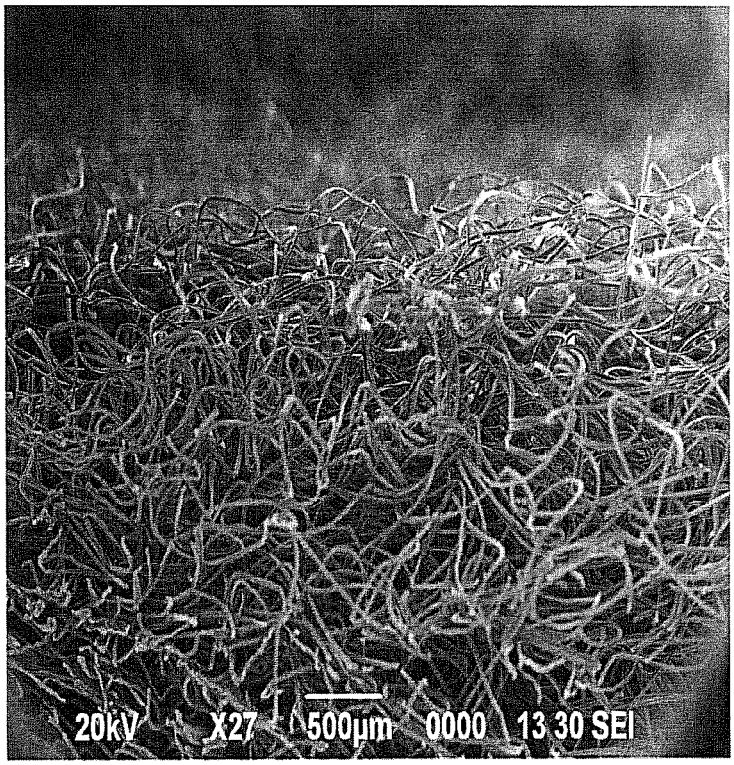
Fig. 1 (Prior Art)
FIG. 1 is a photograph of a cross-section of the nonwoven material disclosed in U.S. patent application Ser. No. 11/559,507.

A nonwoven material has a plurality of randomly oriented and bulked crimped filaments, a plurality of point bonds interconnecting said crimped filaments into a fixed 3-dimensional structure, and either a surface portion of said fixed 3-dimensional structure having a greater density than an inner portion of said 3-dimensional structure or an external surface of said fixed 3-dimensional structure being substantially free of any protruding filaments. The nonwoven material is made by: bulking a filament tow, fixing the bulked tow into a 3-dimensional structure, and calendering the 3-dimensional structure.

DESCRIPTION OF THE INVENTION

The instant invention is an improvement over the nonwoven material disclosed in U.S. patent application Ser. No. 11/559,507. Some, but not all, of the improvements are discussed hereinafter. In one embodiment, the improvement is a nonwoven material where the external surface is substantially free of protruding filaments. This improvement improves the non-stick properties of the material when used as a wound dressing, while reducing the tendency to the filaments to create pills or lint on the surface of the nonwoven. In another embodiment, the improvement is a nonwoven material where a surface portion of the 3-dimensional structure has a greater density than an inner portion of the structure. In one respect, this improvement provides a fluid flow management layer (i.e., the surface portion) that increases the wicking capability of the material. In another respect, this improvement increases the strength (e.g., in both the machine and cross-machine direction) of the nonwoven material. In yet another respect, the porosity of the surface layer can be controlled independently of that for the inner portion of the structure.

Nonwoven material as used herein refers to randomly oriented filaments produced from a bulked crimped tow, and excludes nonwoven fabrics made by dry, wet, or air laying processes, needle-punching, spunbond or meltblown processes, and hydroentangling (spunlacing).

Filament refers to continuous fiber, i.e., a fiber of infinite length when compared to its cross-sectional diameter.

Tow refers to a bundle of filaments without definite twist.

Bulked (or bulking) refers to a processing step whereby a flat tow is caused to swell, grow, expand, and/or increase in thickness, for example, perpendicular to both the machine direction (MD) and the cross machine direction (CD) of the tow. Bulking may be accomplished by use of an air jet.

The filaments may be made of any material that can be formed into filaments. Such materials may include melt spinnable polymers and solution spinnable polymers. Such material includes, but are not limited to: acrylics, cellulosics (e.g., regenerated celluloses (rayons), and cellulose esters), polyamides (e.g., nylons), polyesters (e.g., PET and PBT), polyolefins (e.g., PE, PB, PMP, PP), and mixtures thereof. In one embodiment, the filaments are made of cellulose acetate.

The filaments may have any size. The denier of an individual filament may range from 1-15 dpf (denier per filament) . In one embodiment, the denier may range from 2-10 dpf. In another embodiment, the denier may range from 3-8 dpf.

The filaments may have any cross-sectional shapes. Such shapes include, but are not limited to: round, 'y,' 'x,' crenulated, dog bone, or combinations thereof.

The tow may include any number of filaments. The number of filaments may range in number from 2,500 to 25,000.

The tow may have any total denier. The total denier of the tow may be in the range of 2,500 to 125,000. In one embodiment, the total denier of the tow may range from 15,000 to 75,000. In another embodiment, the total denier of the tow may range from 20,000 to 40,000.

The tow may be crimped. Crimps may be in the range of 5-80 crimps per inch (2-32 crimps per cm). In one embodiment, the crimps may range from 25-35 crimps per inch (10-14 crimps per cm).

The tow may include a finish or may be finished. When a surface finish is applied, the finish may comprise about 0.3-5.0 wt % of the tow. In one embodiment, the finish comprises about 0.5-2.0 wt % of the tow.

The nonwoven material may have any physical dimension or any cross-sectional shape. In one embodiment, the nonwoven fabric may have the following physical dimensions: basis weight of 50-500 g/m$^2$; a width of 50-300 mm; and a thickness of 0.1 mm-5 cm. The cross-sectional shapes may include, for example, rectangular, square, round, or oval. In one embodiment, the cross-sectional shape may be rectangular.

The nonwoven fabric preferably has a fixed, 3-dimensional structure to facilitate, at least, transport of fluid away from the surface, absorbency capacity, and shape retention. The fixed, 3-dimensional structure refers to a bulked filament tow where point bonds, e.g., at places where filaments touch one another, fix the bulked tow into a 3-dimensional shape. The nonwoven fabric is fixed into the 3-dimensional structure by point bonds formed where filaments touch or have contact. The point bonds may be formed by any means. The point bonds may be formed by, for example: a binder (an adhesive-type material that cements the filaments to one another at filament contact points); a plasticizer (a material that softens the polymer of the filaments and allows the filaments to coalesce at filament contact points); and/or external energy source to form point bonds by filament fusion (such energy sources include, for example, thermal, pressure, and/or ultrasonic bonding techniques, which may or may not be facilitated by the use of bicomponent fibers incorporated into the nonwoven fabric).

The choice of the fixing technique may be dependent upon the polymer of the filament. For example, if the filament is a cellulose ester, e.g., cellulose acetate, a plasticizer may be used. Such plasticizers may be, for example, triacetin, triethylene glycol diacetate, glycol monoethyl ether acetate, water, and combinations thereof. In one embodiment, the plasticizer may be added to the nonwoven fabric in the range of 0-20 wt % of the nonwoven fabric. In another embodiment, the plasticizer may be added to the nonwoven in the range of 0-10 wt % of the nonwoven fabric. In another embodiment, the plasticizer is a mixture of one of the organic compounds and water or water alone. This water may have the following non-limiting advantages to the calendering step, discussed below, including: reduction of cost by reducing the amount of plasticizer, facilitating set of the 3-dimensional structure by forming steam during calendering, reducing the temperature required to set the structure, improving the surface characteristics of the nonwoven fabric, and some plasticizing effect (see U.S. Pat. No. 6,224,811, incorporated herein by reference).

The nonwoven fabric may also include the following, alone or in combination:

Radio-opaque detector mechanisms, such as threads or beads, that allows detection when used within a patient. Alternatively, the filaments of the tow may include a radio-opaque filler, e.g., titanium oxide ($TiO_2$).

Radio frequency (RF) tags which could then be detected by an external counting or tracking system and that eliminate the need for manually counting surgical disposables before and after surgery.

Bar coding systems, such as tapes, which could then be detected by an external counting or tracking system, eliminating the need for manually counting surgical disposables before and after surgery. Alternatively, a bar code may be printed (or embossed) directly upon the densified surface of the surface of the instant invention.

Antimicrobial agents intended to slow or kill the growth of microbes and potentially reduce the occurrence of infection. Such agents are conventional and may include, but are not limited to, drugs, chemicals or the like. These agents may be added during filament spinning or with the agent used to fix the structure of the nonwoven fabric or added to the surface of the filaments in any known manner. Antimicrobial agents include, but are not limited to, antibacterial agents, antiviral agents, antifungal agents, and/or antiparisitic agents. Such agents may include, but are not limited to, silver ions, Chitosan, copper ions, and/or chlorinated phenoxy compounds.

The non-adherence properties of the nonwoven fabric may be improved by any known manner. For example, absorbent cellulose derivatives may be used. One absorbent cellulose derivative material is hydroxypropyl cellulose. This material may be added to the surface of the nonwoven fabric that is intended to be in contact with the wound surface. Alternatively, calcium alginate (derived from seaweed) may also be used. This material may be added in sheet or web form to a side of the nonwoven fabric that is intended for contact with the wound and readily dissolves when contacted by a saline solution prior to removal of the dressing from the wound. Calcium alginate is commercially available from Specialty Fibers and Materials, Ltd. In another embodiment, siloxanes may be added to the nonwoven fabric in any conventional manner.

Flexible absorbent binder (FAB) may be added to increase the absorbent capacity of the nonwoven fabric. FAB may be applied to the nonwoven fabric in any conventional manner. One such material is described in U.S. Pat. No. 6,964,803, incorporated herein by reference.

The nonwoven fabric may include any superabsorbent particles (SAP) that are commonly used in the manufacture of personal hygiene products/garments.

These non-limiting additives or treatments can be incorporated into the fiber structure before, during, or after assembly into the nonwoven structure described herein. It may be necessary to apply such additives or treatments post-calendering, where the heating of the nonwoven structure may negatively impact the efficacy of the additive or treatment.

In addition to the above, the instant nonwoven may also be characterized by: 1) a surface portion of the 3-dimensional structure having a greater density than an inner portion of the 3-dimensional structure; and 2) an external surface being substantially free of any protruding filaments.

Figure 2:
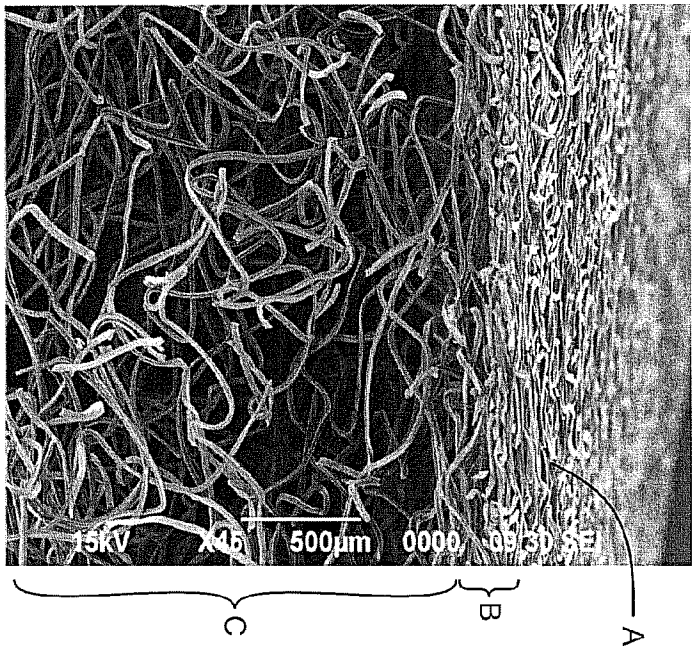
FIGS. 2 and 2A are photographs of a cross-section of two embodiments of the nonwoven material made according to the instant invention.
Figure 2A:
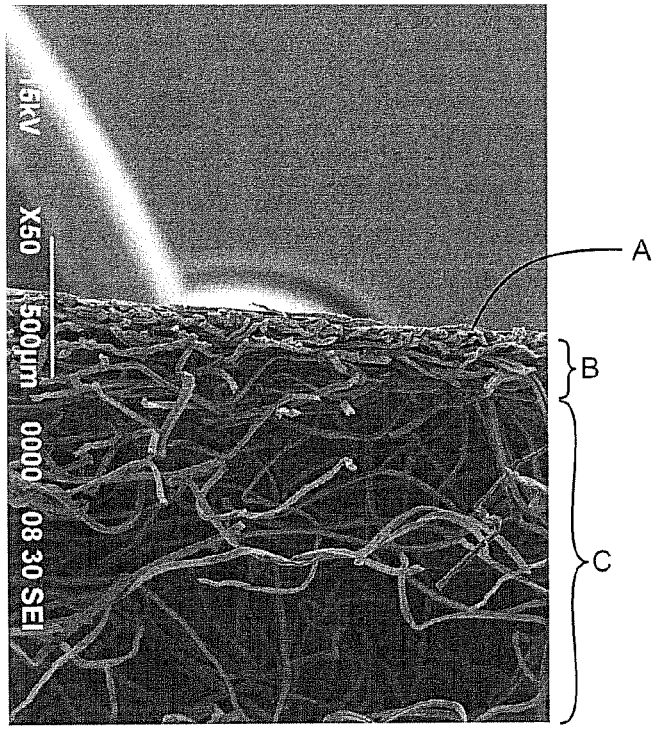
Figure 3:
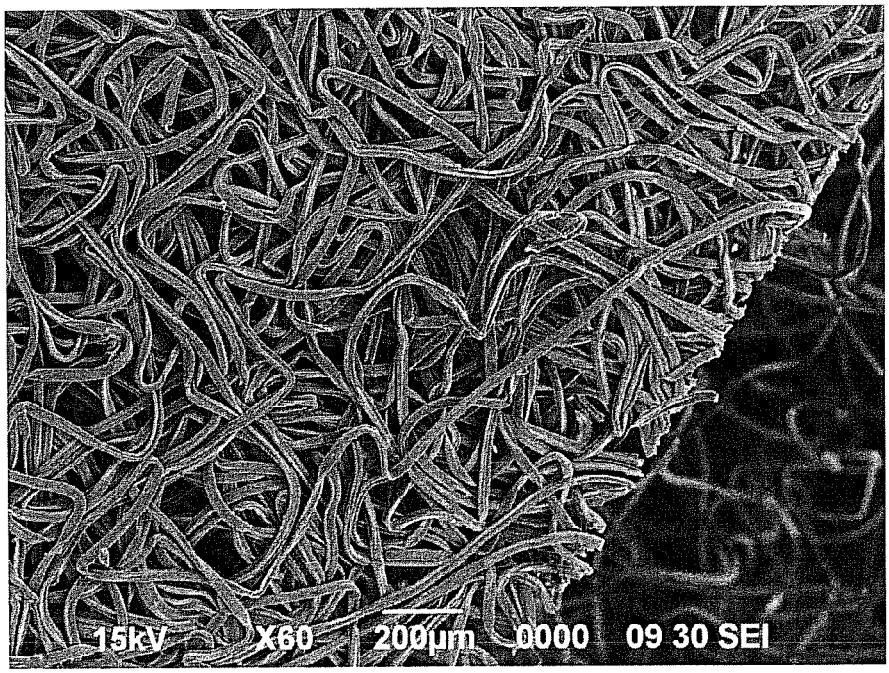
FIG. 3 is a photograph of an external surface (top view) of one embodiment of the nonwoven material made according to the instant invention.
Figure 4:
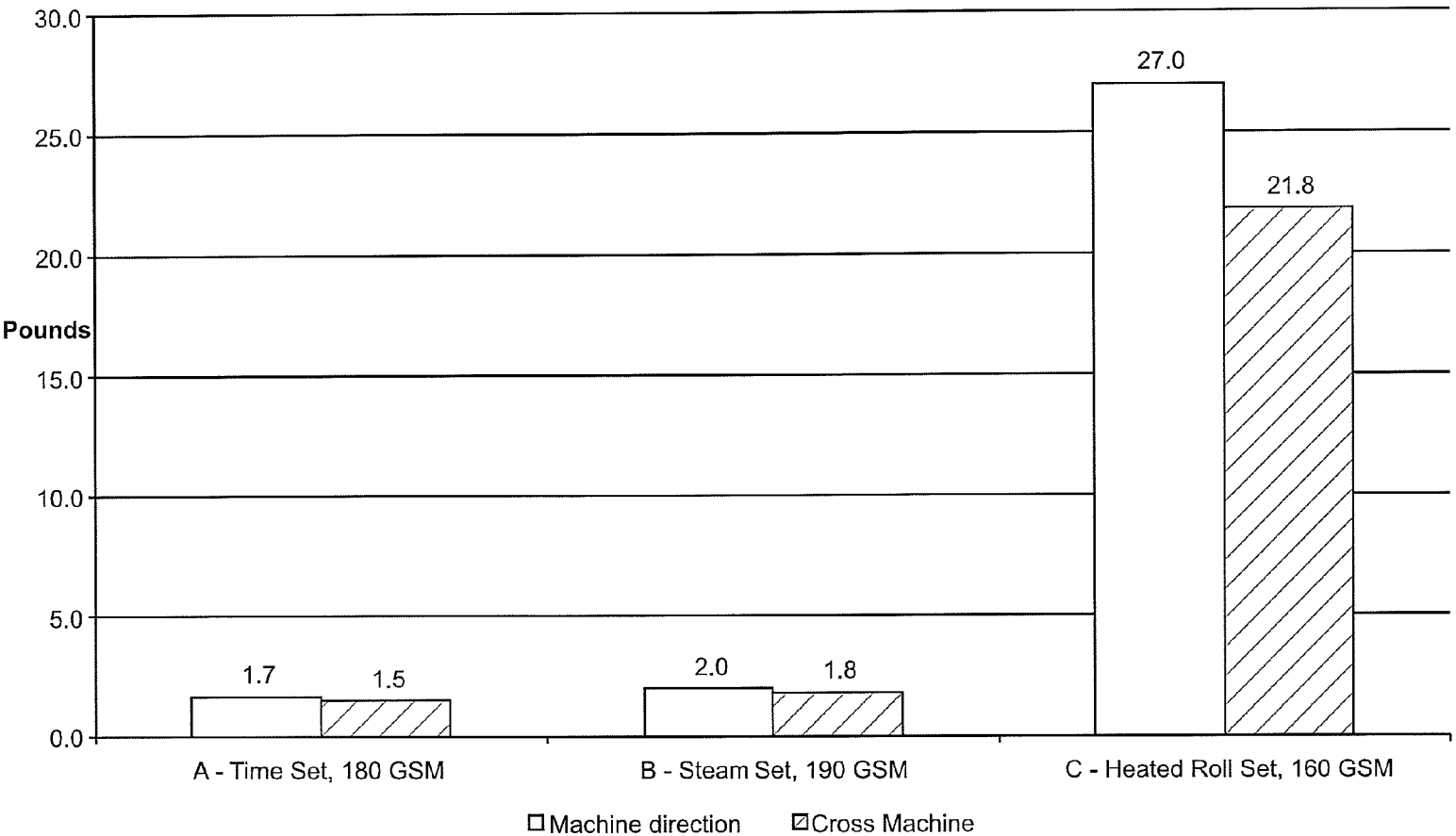
FIG. 4 is a graph illustrating the relative strength of the instant invention to the nonwoven material disclosed in U.S. patent application Ser. No. 11/559,507.

Regarding the first, the surface portion of the 3-dimensional structure having a greater density than an inner portion, reference should be made to FIGS. 2 and 2A. The instant nonwoven, shown in FIGS. 2 and 2A, has an external surface A, a surface portion B, and an inner portion C. Surface portion B has a greater density of filaments (e.g., more filaments per unit volume or more weight per unit volume) than inner portion C. In theory, the maximum density of surface portion B would be a completely consolidated film (i.e., no pores or channels through the surface portion) formed from the filaments. This denser surface portion provides at least two benefits: 1) a fluid flow management layer, and 2) increased strength. The fluid flow management layer has filaments in close proximity thereby increasing the ability to wick fluid. Thus, by controlling the proximity of the filaments (i.e., the density of the layer), one can control the porosity, the strength, and the ability to wick largely independent of the basis weight. This density may be further characterized as a surface density in the range of 0.300-1.000 g/cm$^3$ and a core density in the range of 0.002-0.035 g/cm$^3$, or a surface/core density ratio of 10-110:1. (These density values are calculated as follows: the average thickness of the surface portion is determined by examination of the photomicrographs of the nonwoven; the surface portion is carefully removed from a pre-weighed sample of known area and thickness; the removed surface portion is reweighed; the surface portion density is calculated using the weight of the removed surface portion and the volume calculated from the average thickness and the known area; the core density is calculated by the following formula: Core density=[original sample weight−(2×surface weight)]/[area×(original sample thickness−2×average thickness of surface portion)]. The increased strength may be attributed to the increased number of inter-filament bonding in the surface portion. Referring to FIG. 4, there is illustrated a graph comparing the strength of the instant nonwoven C to the prior art nonwovens A & B. The increased strength may be tailored by controlling the density of the surface portion.

Regarding the second, the external surface being substantially free of any protruding filaments, reference should be made to FIGS. 2 and 2A. FIGS. 2 and 2A, the cross-sectional view of the instant nonwoven, has external surface A. External surface A is substantially free of any protruding filaments. When the instant nonwoven is used as a wound dressing, the lack (or substantial lack) of protruding filaments should reduce the ability of the nonwoven to adhere to the wound.

Alternatively, the instant nonwoven may be formed into a thin (e.g., paper thin) structure having no loft (i.e., no inner portion of a differing density). In other words, with this structure, the density is uniform.

Figure 5:
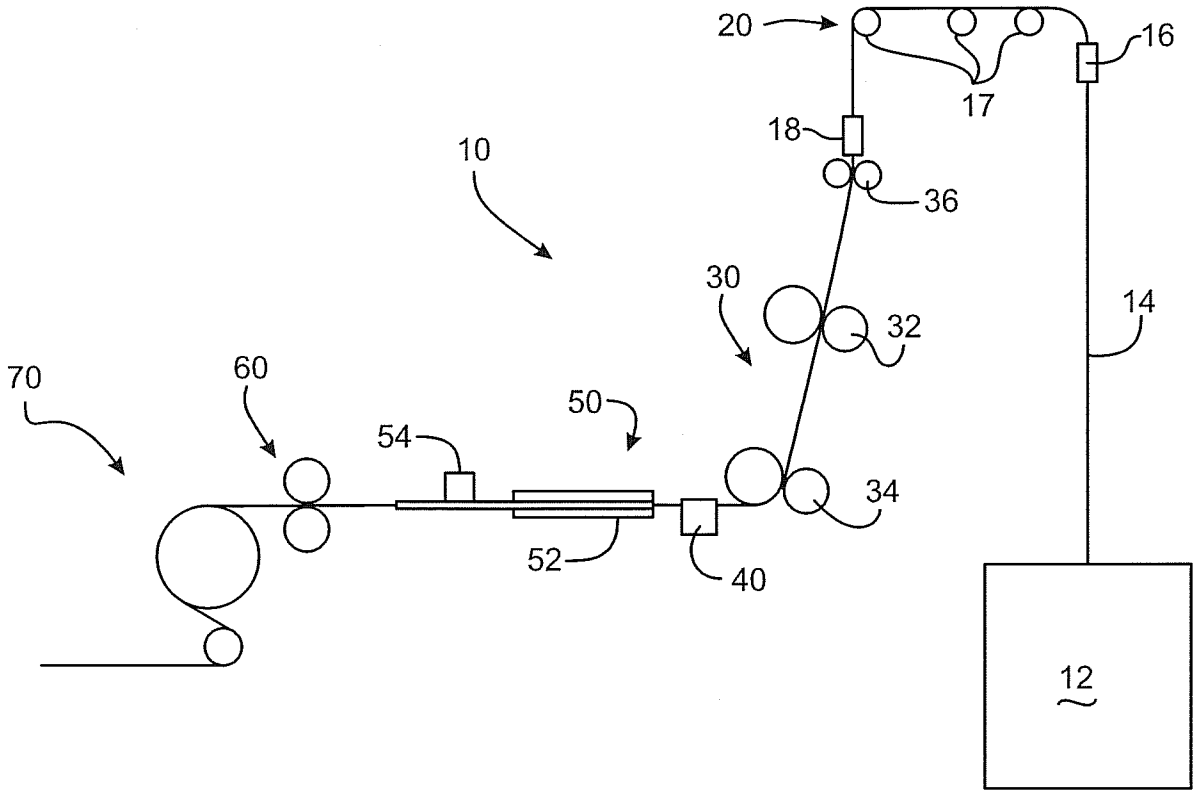
FIG. 5 is a schematic illustration of an embodiment of the process for making the instant nonwoven material.

Referring to FIG. 5, one embodiment of the manufacture of the instant nonwoven material shall be described. The process 10 for making the nonwoven material generally comprises the steps of: bulking 50 the tow, fixing 40 the 3-dimensional structure of the bulked tow ('Fixing,' as noted above, may be accomplished by various means, which may be dictated by the polymer forming the filaments. Accordingly, 'fixing,' as used here, refers to a processing step and may be performed at various points or parts of this processing step may be performed at various points in the overall process, as discussed hereinafter.), and calendering 60 the fixed, bulked crimped tow. In the embodiment shown, bulking 50 the tow further includes spreading 20 the tow and deregistering 30 the tow.

Tow 14 may be pulled from a bale 12. The tow (or tow band) 14 may be spread 20 (i.e., increasing its width from the compressed state in the bale) by use of one or more banding jets 16, 18. During travel, the tow 14 may be guided by one or more guides 17. Additionally, multiple tows may be combined by feeding several tow bands together. In this way, the nonwoven may include differing fibers. Differing fibers may include, but is not limited to, fibers of differing sizes, fibers made of differing materials, fibers having differing additives or surface coatings, fibers of differing chemical, medical, and physical properties, and combinations thereof. With this flexibility, nonwovens with varying functions may be produced. In one specific example of the foregoing, calcium alginate fibers (which, for example, have beneficial gelling properties desired for contact with a wound surface) may be readily combined with other fibers (e.g., those mentioned above) to form a wound care product.

The spread tow is then deregistered 30 in deregistering apparatus that may consist of at least two pairs of driven rollers 32, 34. These driven rollers turn at different speeds. In one embodiment, rollers 34 turning faster than rollers 32. In one embodiment, one roller of each pair is grooved or threaded and the mate is smooth faced (not shown in the figure). Additionally, a pair of pretension rollers 36 may be used to facilitate deregistration of the filaments of the tow band.

Fixing the 3-dimensional structure of the bulked tow may be accomplished before, during, or after the tow is bulked or calendered.

In one embodiment, a plasticizer is added 40 to the deregistered tow prior to bulking to facilitate fixing of the 3-dimensional structure of the nonwoven fabric. The plasticizer may be added in any conventional manner. Application of the plasticizer may be by brushing, spraying, pads, wicks, or other types of plasticizer applicators. Further, the plasticizer may be applied to one or more sides of the tow/bulked tow. When making the embodiment having surfaces substantially-free of protruding fibers, the plasticizer should be directly applied to the surface(s) to ensure that protruding fibers are reduced (no additional plasticizer is needed). Optionally, when the plasticizer method of fixing is used, setting of the fixing may be sped up, i.e., reducing the set time. Speeding up the set may be accomplished in any conventional manner. One such manner may be by the injection of live steam into the bulked tow. The injection of steam may be further aided by a pair of nip rollers which additionally serve to control the thickness and density of the nonwoven fabric. Alternatively, a pair of heated godet rollers may be used to set the fix. These heated godet rollers 60 contact the bulked tow and not only help set the 3-dimensional structure of the tow, but also control the thickness and density of the nonwoven fabric.

In another embodiment, fixing of the 3-dimensional structure may be accomplished after the tow is bulked. In this latter embodiment, the binder and/or the use of the external energy source are applied, in any conventional manner, after the tow has been bulked.

The deregistered tow is bulked 50 in any conventional manner. In one embodiment, the tow is bulked with an air jet 52. Such air jets 52 are known. See, for example, U.S. Pat. Nos. 5,331,976 and 6,253,431, incorporated herein by reference. After bulking and before fixing, it may be necessary to carry the bulked tow because the bulked tow has little to no machine direction (MD) strength. For example, the bulked tow may be carried on: a discrete material (e.g., a tissue) or moving belt or a rotating drum (which may or may not be vacuum assisted). The tissue may be subsequently discarded or the tissue may be incorporated into a subsequent product based upon the nonwoven material. Additionally, the tissue may sandwich the bulked tow. By sandwiching the tow, the bulked tow would have the same characteristic on both sides. Tissue, as used here, includes, but is not limited to: tissue, woven fabric, knitted fabric, other nonwoven, same nonwoven, film or the like. Alternatively, a single, pair, or more than one roller (or set of opposed rollers) can be used to transport the web prior to fixing.

Optionally, a speed controller 54 may be used to control/regulate the basis weight of the nonwoven. Alternately, the basis weight of the nonwoven may be controlled by an additional pair of driven rollers (e.g., nip rollers) located immediately after the air jet.

Additional operating parameters of the foregoing process may be obtained from the relevant portions of U.S. Pat. Nos. 6,253,431; 6,543,106; 6,983,520; 7,059,027; 7,076,848; 7,103,946; 7,107,659; and 7,181,817; each of which is incorporated herein by reference.

After the bulked tow is fixed, it is ready for calendering 60. In calendering 60, the bulked tow is passed through the nip (i.e., gap) of a pair of heated rollers. This action forms the nonwoven material set out above. The major parameter influencing calendering 60 is overfeed. Nip and temperature are also important, but without overfeed, the instant nonwoven will not be formed. (It is understood that composition of filament, line speed, binder/plasticizer, tow overfeed, thermal transfer, and the like also influence, to an extent, calendering and the material produced). Please note that at zero nip (i.e., 0 gap height), paper thin material may be prepared without overfeed. Overfeed is the ratio of the linear speed of the tow entering the air jet to the linear speed of the bulked tow through the nip. Overfeed, at minimum, is about 1.5-2.0:1, and, at maximum, there is no theoretical limit, but the practical limit is about 16:1. For a nonwoven material made from cellulose acetate filaments (one embodiment of the instant invention): the nip may range from about 0-10 mm (alternatively 0-5 mm, or 0-3 mm); and the temperature may range from about 300-400° F. (148.8-204.4° C.). If both rolls are heated, the fixing and densification of the surface portion is accomplished on both external surfaces of the nonwoven material. If only one of the rolls is heated, the densification of the surface portion is accomplished only on the external surface in contact with the heated roll, with heat transfer through the structure assisting in fixing of the nonwoven.

After the bulked tow is calendered, it is ready for subsequent processing 60. Subsequent processing may include, but is not limited to: wind-up; addition of other material or components; sterilization; cutting to shape; packaging; subsequent bonding (e.g., external energy source or adhesives); and combinations thereof. The instant nonwoven fabric may also be joined to one or more other substrates. Such substrates include, but are not limited to, films, meshes, nonwovens, or fabrics (woven or knitted). Non-limiting examples of the forgoing include; barrier films to reduce or prevent strikethrough of exudates from the nonwoven; scrims to provide additional strength to the nonwoven in the machine direction, cross machine direction, or both; and materials that provide additional tactile or aesthetic benefits to the final product.

The nonwoven material disclosed herein may be used in any application, but one contemplated use is in medical applications. One such medical application is wound care products. In general, wound care products need, among other things, the ability to remove fluid from the wound site (a transport phenomenon), to hold the removed fluid (an absorption phenomenon), and not to adhere (stick) to the wound. Wound care product, as used herein, refers to post operative absorbent dressings (or pads), wound pads for cushioning, Gamgee dressings, sponges (including ultra small examples often known as 'pledgets') for use externally or internally, bandages, patient underpads, gauzes for skin preparation/debridement, gauzes including narrow or 'ribbon gauze,' and laporotomy sponges for internal operating room (OR) uses. This material may also be used as a component or in its entirety in a wound dressing, a component or in its entirety in a bandage, a component or in its entirety in an eye dressing, a component or in its entirety in a nursing pad, a component or in its entirety in absorbent materials used in autopsy, a component or in its entirety in dental dressings, a component or in its entirety in veterinary dressings, or one of the other listed applications.

Other uses for the nonwoven material include, for example, food pads, wipes, filter media, and absorbent articles.

EXAMPLES

The foregoing invention shall be further illustrated by the following non-limiting examples.

In the following tables, data is presented which illustrates the influence of nip and temperature upon product properties.

| DPF | Heated Rollers GAP (mm) | PZ[1] % | Heated Calender TEMP (F.) | GSM[2] | Breaking Strength Machine Direction LBS | Breaking Strength Cross Machine Direction LBS | MD/CD Ratio | ABS[3] g/g | Sink[3] time sec. | Density g/cm$^3$ |
|---|---|---|---|---|---|---|---|---|---|---|
| 2.5 | 0 | 12.6 | 350 | 87 | 12.71 | 7.61 | 1.7 | 4.2 | 2.1 | 0.087 |
| 2.5 | 0 | 11.7 | 350 | 155 | 18.02 | 13.14 | 1.4 | 8.7 | 3.5 | 0.052 |
| 2.5 | 0 | 15.2 | 350 | 95 | 18.21 | 13.79 | 1.3 | 2.8 | 2.0 | 0.095 |
| 2.5 | 0 | 10.1 | 350 | 163 | 17.73 | 18.92 | 0.9 | 8.3 | 3.2 | 0.163 |
| 2.5 | 0 | 14.6 | 400 | 86 | 24.14 | 15.04 | 1.6 | 3.5 | 2.3 | 0.086 |
| 2.5 | 0 | 6.4 | 400 | 163 | 19.65 | 12.59 | 1.6 | 6.6 | 3.3 | 0.163 |
| 2.5 | 0 | 17.8 | 400 | 91 | 20.76 | 10.82 | 1.9 | 3.0 | 1.8 | 0.091 |
| 2.5 | 0 | 10.6 | 400 | 159 | 27.01 | 21.82 | 1.2 | 5.9 | 2.6 | 0.159 |
| 2.5 | 0.635 | 13.3 | 350 | 97 | 3.93 | 0.38 | 10.3 | 22.6 | 4.6 | 0.012 |
| 2.5 | 0.635 | 9 | 350 | 164 | 2.21 | 0.71 | 3.1 | 23.1 | 8.3 | 0.012 |
| 2.5 | 0.635 | 11.7 | 350 | 104 | 2.91 | 0.4 | 7.3 | 21.7 | 4.2 | 0.021 |
| 2.5 | 0.635 | 12.6 | 350 | 162 | 1.81 | 0.55 | 3.3 | 23.2 | 8.4 | 0.014 |
| 2.5 | 0.635 | 17.1 | 400 | 89 | 2.55 | 0.83 | 3.1 | 20.3 | 4.4 | 0.030 |
| 2.5 | 0.635 | 7.7 | 400 | 168 | 1.77 | 1.91 | 0.9 | 19.7 | 7.1 | 0.019 |
| 2.5 | 0.635 | 7.4 | 400 | 105 | 2.18 | 1.17 | 1.9 | 20.0 | 4.0 | 0.021 |
| 2.5 | 0.635 | 12.2 | 400 | 174 | 2.19 | 2.24 | 1.0 | 20.1 | 5.3 | 0.019 |

[1]PZ = Triacetin

[2]GSM = grams/meter$^2$

[3]ABS - Absorption by INDA STANDARD TEST (IST 10.1 (95))

[4]Heated roller speeds were set at 30 meters/minute, Tow Opening system overfeed was adjusted to obtain targeted basis weights (grams/meter$^2$)

| DPF | Heated Rollers GAP (mm) | PZ[1] % | Heated Calender TEMP (F.) | GSM[2] | Breaking Strength Machine Direction LBS | Breaking Strength Cross Machine Direction LBS | MD/CD Ratio | ABS[3] g/g | Sink[3] time sec. | Density g/cm$^3$ |
|---|---|---|---|---|---|---|---|---|---|---|
| 7.3 | 0 | 6.1 | 350 | 102 | 6.89 | 6.79 | 1.0 | 4.4 | 2.3 | 0.102 |
| 7.3 | 0 | 4.1 | 350 | 174 | 6.14 | 11.88 | 0.5 | 9.6 | 4.3 | 0.058 |
| 7.3 | 0 | 9.4 | 350 | 106 | 9.73 | 15.74 | 0.6 | 6.0 | 2.3 | 0.106 |

-continued

| DPF | Heated Rollers GAP (mm) | PZ[1] % | Heated Calender TEMP (F.) | GSM[2] | Breaking Strength Machine Direction LBS | Breaking Strength Cross Machine Direction LBS | MD/CD Ratio | ABS[3] g/g | Sink[3] time sec. | Density g/cm[3] |
|---|---|---|---|---|---|---|---|---|---|---|
| 7.3 | 0 | 4.9 | 350 | 178 | 13.19 | 13.49 | 1.0 | 8.6 | 3.9 | 0.178 |
| 7.3 | 0 | 10.7 | 400 | 89 | 20.39 | 18.71 | 1.1 | 2.6 | 1.7 | 0.089 |
| 7.3 | 0 | 5.8 | 400 | 171 | 23.74 | 25.53 | 0.9 | 5.8 | 3.8 | 0.171 |
| 7.3 | 0 | 16.7 | 400 | 90 | 19.43 | 16.49 | 1.2 | 3.4 | 1.8 | 0.090 |
| 7.3 | 0 | 8.3 | 400 | 169 | 28.55 | 27.73 | 1.0 | 4.9 | 2.5 | 0.017 |
| 7.3 | 0.635 | 6.2 | 350 | 107 | 2.77 | 0.49 | 5.7 | 21.2 | 6.8 | 0.012 |
| 7.3 | 0.635 | 6.5 | 350 | 192 | 1.14 | 0.63 | 1.8 | 20.5 | 7.7 | 0.012 |
| 7.3 | 0.635 | 8.3 | 350 | 121 | 2.53 | 0.47 | 5.4 | 21.6 | 5.6 | 0.011 |
| 7.3 | 0.635 | 5.1 | 350 | 193 | 1.17 | 1.18 | 1.0 | 20.8 | 6.6 | 0.014 |
| 7.3 | 0.635 | 8.8 | 400 | 106 | 2.28 | 0.48 | 4.8 | 19.0 | 4.4 | 0.018 |
| 7.3 | 0.635 | 6.1 | 400 | 178 | 1.49 | 3.6 | 0.4 | 17.7 | 5.8 | 0.016 |
| 7.3 | 0.635 | 13.4 | 400 | 100 | 1.99 | 0.93 | 2.1 | 18.6 | 4.0 | 0.020 |
| 7.3 | 0.635 | 7.8 | 400 | 181 | 1.46 | 2.36 | 0.6 | 17.8 | 6.1 | 0.016 |

[1]PZ = Triacetin

[2]GSM = grams/meter[2]

[3]ABS - Absorption by INDA STANDARD TEST (IST 10.1 (95))

[4]Heated roller speeds were set at 30 meters/minute, Tow Opening system overfeed was adjusted to obtain targeted basis weights (grams/meter[2]

The present invention may be embodied in other forms without departing from the spirit and the essential attributes thereof, and, accordingly, reference should be made to the appended claims, rather than to the foregoing specification, as indicated the scope of the invention.

We claim:

1. A nonwoven material comprising:

a plurality of randomly oriented and bulked crimped filaments, each filament ranging from 1-15 dpf, a plurality of point bonds interconnecting said crimped filaments into a fixed 3-dimensional structure, and a surface portion of said fixed 3-dimensional structure having a greater density than an inner portion of said 3-dimensional structure, wherein a ratio of surface portion density to inner portion density being in a range of 10-110:1.

2. The nonwoven material of claim 1 wherein said filaments being selected from the group consisting of: acrylics, cellulosics, polyamides, polyesters, polyolefins, or mixtures thereof.

3. The nonwoven material of claim 1 wherein said point bonds being selected from the group consisting of: a binder adhering filaments at contact points, filaments coalesced together at contact points, filaments fused together at contact points, and combinations thereof.

4. The nonwoven material of claim 1 wherein the nonwoven material excluding nonwoven fabrics made by dry, wet, or air laying processes, needle-punching, spunbond or meltblown processes, and hydroentangling.

5. The nonwoven material of claim 1 being a wound care product.

6. A nonwoven material comprising:

a plurality of randomly oriented and bulked crimped filaments, each filament ranging from 1-15 dpf, a plurality of point bonds interconnecting said crimped filaments into a fixed 3-dimensional structure, a surface portion of said fixed 3-dimensional structure having a greater density than an inner portion of said 3-dimensional structure, and an external surface of said fixed 3-dimensional structure being substantially free of any protruding filaments, wherein a ratio of surface portion density to inner portion density being in a range of 10-110:1.

7. The nonwoven material of claim 6 wherein said filaments being selected from the group consisting of: acrylics, cellulosics, polyamides, polyesters, polyolefins, or mixtures thereof.

8. The nonwoven material of claim 6 wherein said point bonds being selected from the group consisting of: a binder adhereing filaments at contact points, filaments coalesced together at contact points, filaments fused together at contact points, and combinations thereof.

9. The nonwoven material of claim 6 being a wound care product.

10. The nonwoven material of claim 1 wherein said surface portion covering an entire external surface of the nonwoven material.

11. The nonwoven material of claim 6 wherein said surface portion covering an entire external surface of the nonwoven material.

12. The nonwoven material of claim 6 wherein the nonwoven material excluding nonwoven fabrics made by dry, wet, or air laying processes, needle-punching, spunbond or meltblown processes, and hydroentangling.

13. A nonwoven material comprising:

a plurality of randomly oriented and bulked crimped filaments, each filament ranging from 1-15 dpf, a plurality of point bonds interconnecting said crimped filaments into a fixed 3-dimensional structure, and a surface portion of said fixed 3-dimensional structure having a greater density than an inner portion of said 3-dimensional structure, wherein a ratio of surface portion density to inner portion density being in a range of 10-110:1 and the nonwoven material excluding nonwoven fabrics made by dry, wet, or air laying processes, needle-punching, spunbond or meltblown processes, and hydroentangling.

* * * * *